US005739487A

United States Patent [19]

Best

[11] Patent Number: 5,739,487

[45] Date of Patent: Apr. 14, 1998

[54] ON SWITCH WITH SEPARATE OFF RELEASE ACTUATOR

[75] Inventor: Gary R. Best, Hamilton, Ill.

[73] Assignee: Methode Electronics, Inc., Chicago, Ill.

[21] Appl. No.: 385,282

[22] Filed: Feb. 8, 1995

[51] Int. Cl.[6] ..... H01H 9/20

[52] U.S. Cl. ..... 200/5 E; 200/50 C

[58] Field of Search ..... 200/4, 5 R, 5 A, 200/5 B, 5 E, 6 R, 50 R, 50 C, 552, 17 R, 61.54, 16 R, 16 A, 16 C, 518

[56] References Cited

U.S. PATENT DOCUMENTS

| | | | |
|---|---|---|---|
| 3,294,926 | 12/1966 | Dellert et al. | 200/5 |
| 4,095,059 | 6/1978 | Nishioka et al. | 200/5 B |
| 4,436,970 | 3/1984 | Swisher | 200/61.56 |
| 4,692,573 | 9/1987 | Fukuyama et al. | 200/50 C |
| 4,837,411 | 6/1989 | Best | 200/5 A |
| 4,994,635 | 2/1991 | Cummings et al. | 200/61.86 |

*Primary Examiner*—Brian W. Brown
*Assistant Examiner*—Michael A. Friedhofer
*Attorney, Agent, or Firm*—David L. Newman

[57] ABSTRACT

A switching assembly having an on switch with a separate off release actuator. The switching assembly has a switch which has both an on position and an off position. Connected on the switch is an on button which has both a released position and a depressed position. The moving of the on button into the depressed position causes the switch to toggle into the on position. Also connected to the switch is an actuator rod which provides for the locking and releasing of the switch from the on position. The actuator rod is connected to an off button which has both a depressed position and a released position. Moving the off button into the depressed position causes the switch to toggle into the off position. Furthermore, a spring is connected to the actuator rod for maintaining the on switch in the on position until the actuator is forced to release the on switch from the on position.

1 Claim, 6 Drawing Sheets

ON SWITCH WITH SEPARATE OFF RELEASE ACTUATOR

BACKGROUND OF THE INVENTION

This invention pertains to a switching assembly, and in particular to a switching assembly having an on switch with a separate off release actuator.

The prior art discloses many types of switches which can be latched in the "on" position. Each of these switches is designed to remain in the "on" position until it is toggled into the "off" position. In toggling the switch from the "on" position to the "off" position, several prior art designs incorporate a two button configuration consisting of both an "on" button and a separate "off" button. Correspondingly, the switch is in the "on" position when the "on" button is depressed and, likewise, the switch is released from the "on" position when the "off" button is depressed.

There are several problems with the prior art switches discussed above. First, the two button configuration used in the prior art operates by using electrical circuitry which is expensive to manufacture. Second, the two button configuration is not capable of holding the "on" button in the depressed state so that an indication is given that the switch is in the "on" position.

In view of the above, it is an object of the present invention to provide an electrical switching assembly having an on switch with a separate off release actuator.

Another object of the present invention is to provide an indication of whether the switch is in the on position.

Furthermore, it is an object of the present invention to provide a simple and inexpensive switching assembly design having an on switch with a separate off release actuator.

SUMMARY OF THE INVENTION

In one form of the invention, a switching assembly is provided which has an on switch with a separate off release actuator. The switching assembly has a switch which can be toggled into either an on position or an off position. Connected to the switch is an actuator rod which provides for locking the switch in the on position and also for releasing the switch from the on position.

The invention further provides for an on button to be connected to the switch. The on button has both a depressed position and a released position. The depressed position of the button corresponds to the on switch being toggled into the on position.

Likewise, the invention also provides for an off button to be connected to the actuator rod. The off button has both a depressed position and a released position. The depressed position corresponds to the switch being toggled into the off position.

The switching assembly invention may also have a spring connected to the actuator rod for holding the switch in the on position until the actuator is forced to release the switch.

In another form of the invention, a switching assembly is provided which has a switch having an on position and in addition structure is provided for locking and releasing the switch from the on position.

The switching assembly invention also provides for an on button and an off button. The on button is connected to the switch and has a first position to activate the switch. Correspondingly, the off button is connected to the locking and releasing structure and has a first position to release the switch from the on position.

Additionally, the switching assembly invention provides for a biasing means to be connected to the locking and releasing structure for maintaining the switch in the on position until the locking and releasing structure is forced to release the switch.

Various means for practicing the invention and other advantages and novel features thereof will be apparent from the following detailed description of an illustrative preferred embodiment of the invention.

BRIEF DESCRIPTION OF THE DRAWINGS

There is shown in the drawings a presently preferred embodiment of the present invention, wherein like numerals in the various figures pertain to like elements, and wherein.

DETAILED DESCRIPTION OF THE PRESENTLY PREFERRED EMBODIMENTS

Figure 1:
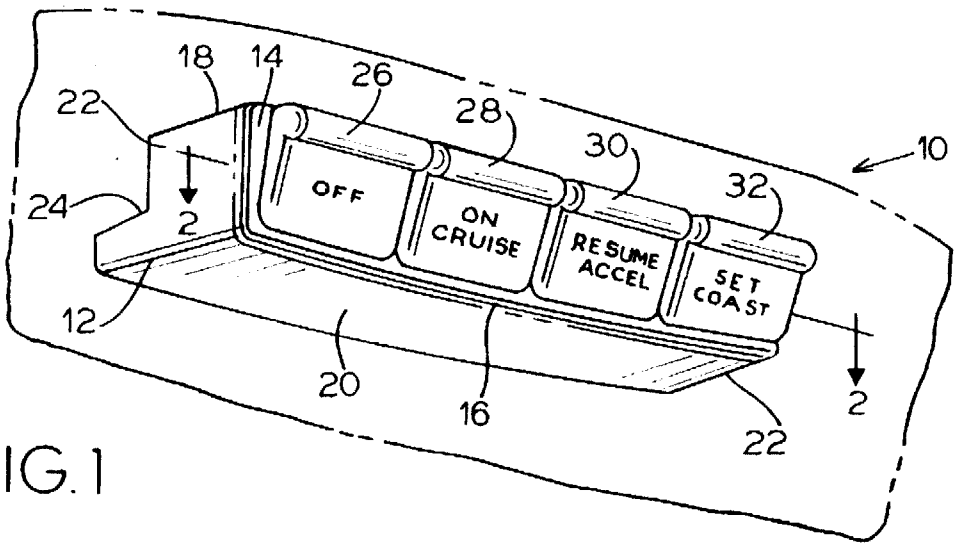
FIG. 1 is a perspective view of the main housing of a cruise control assembly having an on button with a separate off release actuator button.

Referring to the drawings, and particularly to FIG. 1, a perspective view of a cruise control assembly 10 for installation onto an automobile steering wheel is shown (steering wheel not depicted). The cruise control assembly 10 has a main housing 12. The front 14 of the main housing 12 is generally rectangular in shape with a droop in its lower portion 16. Extending perpendicularly from the front 14 of the main housing 12 is a top panel 18 and a bottom 20 panel. Both the top panel 18 and the bottom panel 20 extend from opposite sides of the front 14 of the main housing 12 with the bottom panel extending from the lower portion 16 of the front. Connected to the top panel 18, the bottom panel 20, and the front 14 of the main housing 12 are two side panels 22,22. Each side panel 22 has an indented portion 24 which results in a generally L-shape.

Mounted on the front 14 of the main housing 12 are four buttons 26, 28, 30, and 32, respectively. The buttons 26, 28, 30, and 32 cover almost the entire front 14 and are aligned in a single row. Button 26 is labeled "off" and thus is used for switching the cruise control system off. Likewise, button 28 is labeled "on/cruise" and is used for switching the cruise control system on. Similarly, button 30 is labeled "resume/accel" and is used for resuming and accelerating the cruise control system. Furthermore, button 32 is labeled "set/coast" and is used for setting and decelerating the cruise control system. While a preferred embodiment of the present invention is shown having the particular button functions described above, the present invention may provide actuation for a wide variety of switches.

Figure 2:
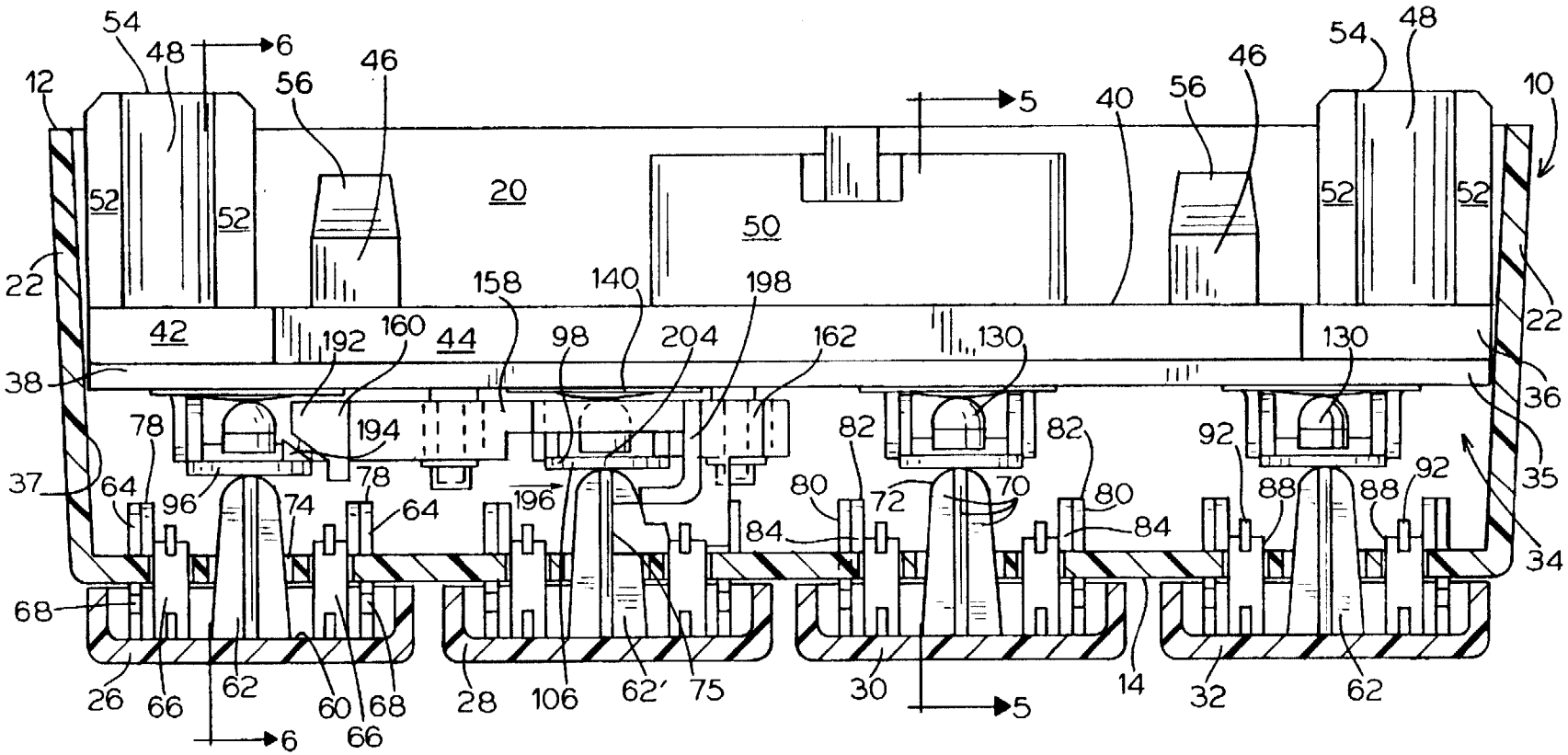
FIG. 2 is an enlarged cross-sectional plan view of the main housing taken along line 2—2 of FIG. 1.

Turning to FIG. 2, an enlarged cross-sectional plan view of the main housing 12 is depicted taken along line 2—2 of FIG. 1. Within the cruise control assembly 10 is a switching assembly 34 having a circuit board 35 made of glass filled nylon which mounts onto a back wall 36. The back wall 36 is formed so that it will fit within the cavity 37 formed within the main housing 12 by the two sides 22,22, the top panel 18, and the bottom panel 20 (See FIG. 1).

The back wall 36 has a front surface 38, a parallel rear surface 40, and a top surface 42 which adjoins to both the front and rear surfaces. The front surface 38 of the back wall 36 faces the cavity 37 within the main housing 12 and, likewise, the rear surface 40 faces away from the cavity. Protruding from the top surface 42 of the back wall 36 is a stop 44 which extends a unilateral distance from the center of the top surface. The stop 44 abuts the top panel 18 of the main housing 12 in order to ensure proper positioning of the back wall 36 within the main housing.

Extending perpendicularly from the rear surface 40 of the back wall 36 are two guide ears 46,46, two mounting collars 48,48, and a connector housing 50. The connector housing 50 is generally rectangular in shape and forms a cavity for the insertion and support of a connector (connector not shown). In addition, the mounting collars 48,48 are positioned adjacent to each end of the back-wall 36. The mounting collars 48,48 provide for external mounting of the cruise control assembly 10. Each mounting collar 48 is tubular in construction with a plurality of collar supports 52 extending along the entire length of the collar. The distal end 54 of each mounting collar 48 provides for access to an elongated cavity (cavity not depicted). Likewise, in order to facilitate mounting of the switching assembly 34, the guide ears 46,46 are mounted adjacent to each of the two mounting collars 48,48 and the connector housing 50. Each guide ear 46 has a generally flat construction with a tapered distal end 56.

As stated previously, each of the buttons 26, 28, 30, and 32 are mounted on the front 14 of the main housing 12. Each button is generally rectangular in shape. Extending from the back 60 of each button is a button driver 62, two support beams 64,64, two travel limit arms 66,66, and two abutment pads 68,68. Each button driver 62 is located approximately in the center of the back of the button and consists of four beams 70 (only three beams shown for each button driver). The four beams 70 symmetrically adjoin each other and are tapered so that the button driver 62 is generally conical in shape with a rounded distal end 72. A button driver passage 74 is provided within the front 14 of the main housing 12 in order to allow the button driver 62 to extend within the main housing. All of the button drivers are of similar construction except for the button driver 62' extending from button 28. The button driver 62' extending from button 28 has a notch 75 which is cut in one of the beams 70 towards the distal end 72.

Attached to each of the buttons is a pair of support beams 64 which provided for pivotal movement. Each support beam 64 passes through the front 14 of the main housing 12 via a pivot passage (pivot passage not shown). Each support beam 64 has one end attached to the back 60 of the button and the other, distal end 78, being rounded. Adjacent to the distal end 78 of each support beam is a pivot hole 80 which extends through the beam. Pivotally engaged within each pivot hole 80 is a pivot post. Each pivot post extends perpendicularly from the distal end 82 of a strut member 84 which is connected to the main housing 12.

In order to stop the pivotal movement of each button, the two abutment pads 68 extend from the back 60 of each button towards the front 14 of the main housing 12. Each pair of abutment pads 68 will strike the front 14 of the main housing 12 when the pivotal movement of the button, towards the front of the main housing, is to be terminated.

Likewise, the two travel limit arms 66 are provided on the back 60 of each button for limiting the pivotal movement of the button away from the main housing 12. Each travel limit arm 66 extends perpendicularly from its corresponding button and protrudes through the front 14 of the main housing 12 via a passage 88. Each of the travel limit arms 66 has one end connected to the back 60 of the button and the other, distal end, having a barb 92. The barb 92 is positioned so that it cannot be withdrawn though the passage 88 without catching on the front 14 of the main housing 12. Thus, each pair of travel limit arms 66 will catch onto the front 14 of the main housing 12 when the pivotal movement of the button, away from the front of the main housing, is to be discontinued.

Figure 3:
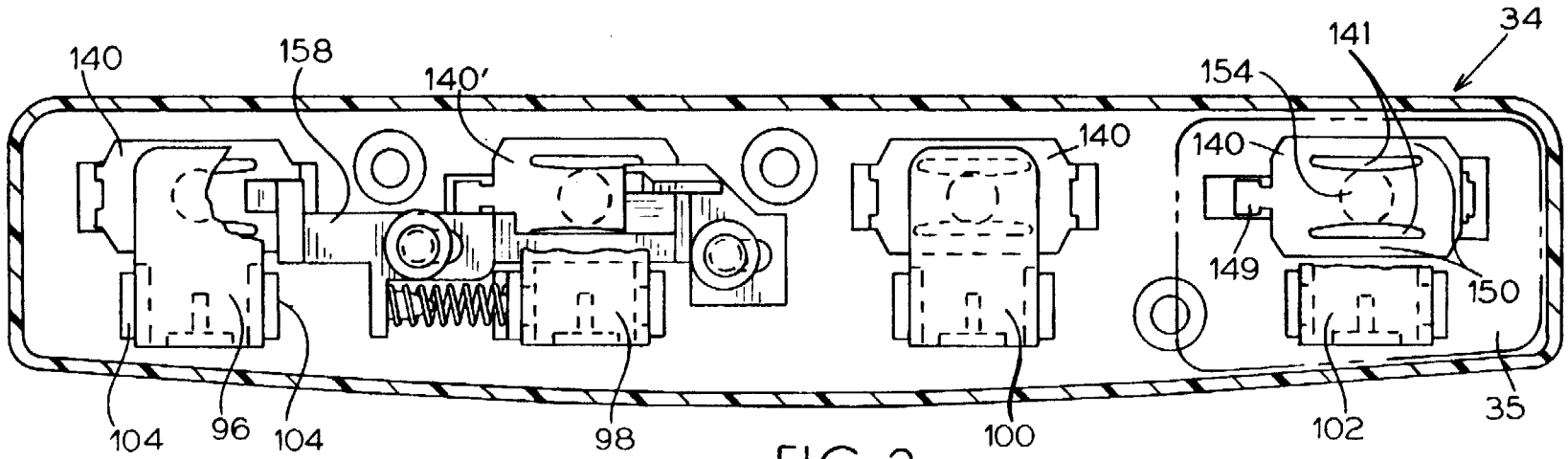
FIG. 3 is an enlarged front view of the main housing's switching assembly depicted in FIG. 2 which includes a partial fragmentary view of several of the switching assembly's paddles.

As previously stated, attached to the back wall 36 is circuit board 35 of the switching assembly 34. Turning to FIG. 3, an enlarged front view of the main housing's switching assembly 34 is depicted which includes a partial fragmentary view of several of the switching assembly's paddles 96, 98, 100, and 102. In a preferred embodiment, the paddles are constructed of a polymer material such as Astel. Each of the paddles 96, 98, 100, and 102 are pivotally connected to the circuit board 35 via a set of mounting brackets 104. The mounting brackets 104 extend perpendicularly from the circuit board 35.

Figure 4:
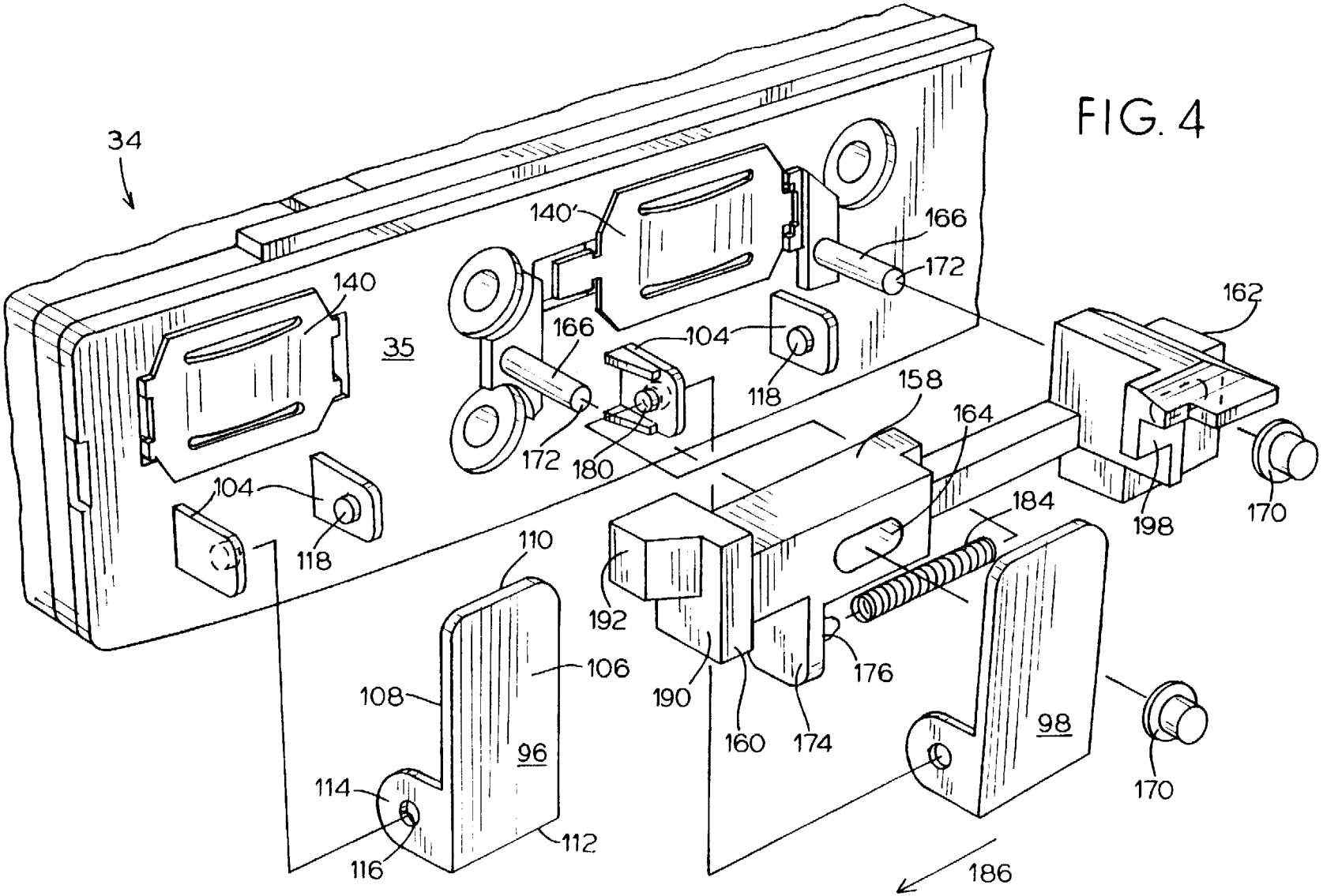
FIG. 4 is an enlarged exploded perspective view of two paddles from the switching assembly depicted in FIG. 3.

Turning to FIG. 4, an enlarged exploded view of paddles 96 and 98 are depicted from the switching assembly 34 shown in FIG. 3. Each paddle has a rectangularly shaped top portion 106, a corresponding bottom portion 108, a first end 110, an opposite second end 112, and two tabs 114. The tabs 114 are located on each side of the paddle, are adjacent to the second end 112 of the paddle, and extend perpendicularly from the paddle's bottom portion 108 (only one side of each paddle is shown). Adjacent to the distal end of each tab 114 is a mounting hole 116. Each paddle is pivotally mounted onto a set of mounting brackets 104 by inserting a pivot post 118 within each of the paddle's mounting holes 116. The pivot posts 118 provided for each set of mounting brackets 104 extend towards each other and protrude from the distal end of each mounting bracket.

Figure 5:
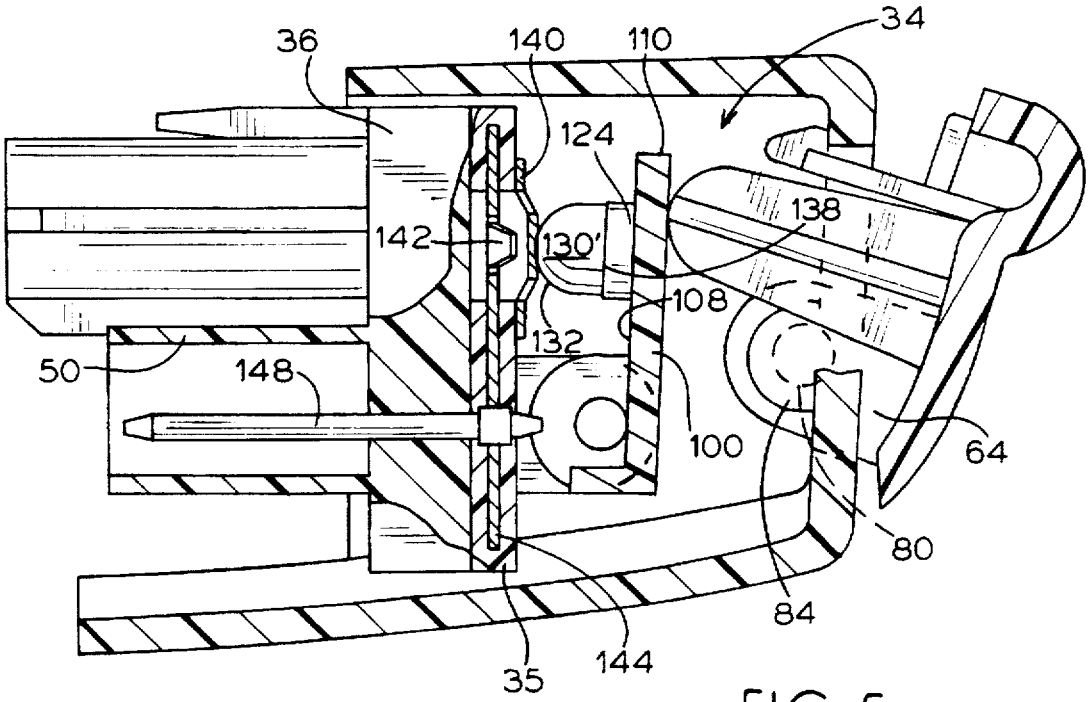
FIG. 5 is an enlarged cross-sectional side view of the switching assembly taken along line 5—5 of FIG. 2 in a non-depressed position with a partial fragmentary view of the cruise control assembly's back wall.

Referring to FIG. 5, an enlarged cross-sectional side view of the switching assembly 34 taken along line 5—5 of FIG. 2 is depicted with a partial fragmentary view of the back wall 36. The switch paddle 100 shown in FIG. 5 is generally representative of all of the paddles used in the switching assembly 34. A nipple mount 124 is located on the bottom portion 108 of the paddle 100 and adjacent to the first end 110. The nipple mount 124 is generally circular in shape with a pin extending from its center and away from the bottom portion 108 of the paddle (pin not shown). Mounted onto the pin, and abutting the nipple mount 124, is a flexible nipple 130. In a preferred embodiment, the flexible nipple 130 is made of a rubber material such as silicone and has a rounded first end 132 and a flat second end 138 which abuts against the nipple mount 124.

The rounded first end 132 of the nipple 130 abuts against a resilient contactor 140. Each resilient contactor 140 is made of a conductive metallic material and may, as depicted in FIG. 5, be used to form an electrical connection with a finger member 142 which extends from a layer of conductive material 144 within the circuit board 35. Also extending from the layer of conductive material 144 is a conductive pin 148 which extends within the back wall's connector housing 50 for making an electrical connection with the electrical contacts of a connector (connector not shown).

Referring back to FIG. 3, the two different types of contactors 140 used in the construction of the switching assembly 34 are depicted. As shown in FIG. 3, one type of contactor has an ear 149 extending off of one of its ends and the other type of contactor does not have an ear. The contactors 140 are constructed of a flat piece of metallic material which has two parallel slots 141 cut therein. The slots 141 result in the plate being separated into two beams 150 with a center section 154 positioned between the beams. The ends of each of the beams 150 is bent so that it gives the contactor 140 a generally convex shape with the center section 154 being outwardly bowed. The contactor 140 will deform once pressure is applied to the center section 154. However, due to the resiliency of the contactor 140, it will regain its initial configuration once the applied pressure is released.

Figure 6:
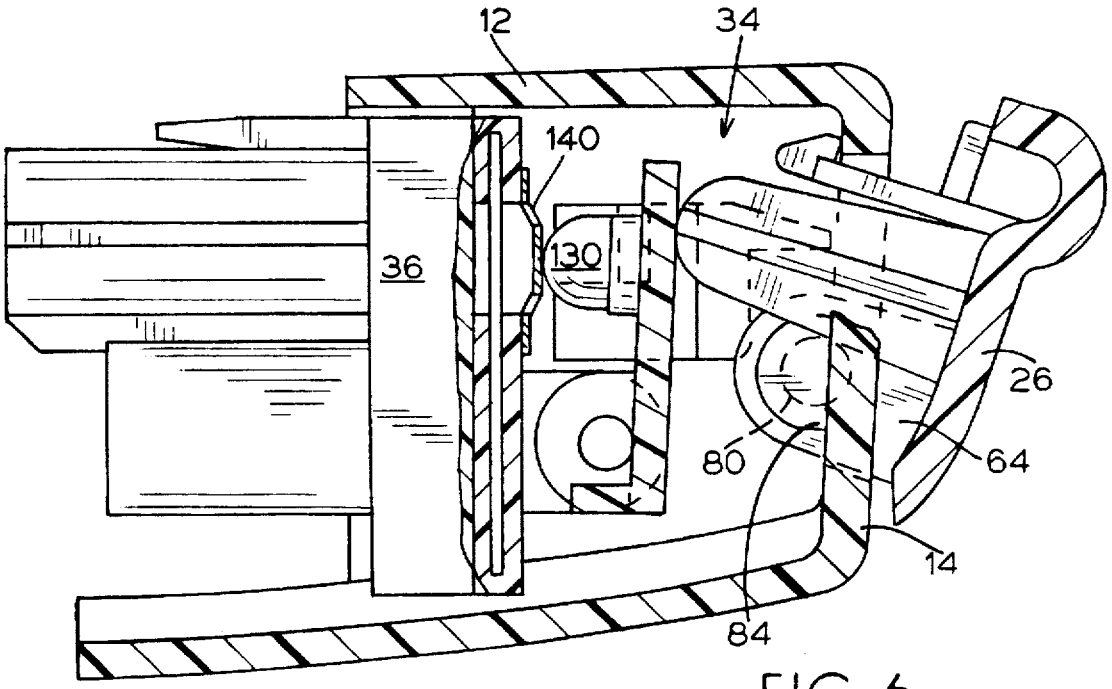
FIG. 6 is an enlarged cross-sectional side view of the switching assembly taken along line 6—6 of FIG. 2 in a non-depressed position with a partial fragmentary view of the cruise control assembly's back wall.

Turning to FIG. 6, an enlarged cross-sectional side view of the switching assembly 34 taken along line 6—6 of FIG. 2 is depicted with a partial fragmentary view of the back wall 36. As shown in FIG. 6, the contactor 140 is used only to provide a counter force against any effort to push the off button 26 towards the front 14 of the main housing 12 as a finger member is absent from beneath the contactor 140 for making an electrical connection. Conversely, in FIG. 5, the contactor 140' is used to provide a counter force and is also used to form an electrical connection with the finger member 142 extending from the conductive material 144 of the circuit board 35. Thus, the contactor 140' and finger member 142 operate as an on switch which is activated (i.e., in the on position) when the on button is depressed.

Turning back to FIG. 3, an actuator rod 158 is depicted between paddle 96 and paddle 98 which operates as an off release actuator. In a preferred embodiment, the actuator rod 158 is made of a polymer material such as a mineral filled nylon and serves as a means for locking and releasing the on switch from the on position. Moving to FIG. 4, the actuator rod 158 has a first end 160, a second end 162, and a slot 164 adjacent to each end. Inserted within each slot 164 is a retaining post 166. Each retaining post 166 extends perpendicularly from the circuit board 35. On the distal end 172 of each retaining post 166 is a cap 170 which slidably secures the actuator rod 158 onto the circuit board 35.

Located adjacent to the first end 160 of the actuator rod 158 is an arm member 174. Towards the distal end of the arm member 174 is a pin member 176 which protrudes towards paddle 98. Correspondingly, a stud member 180 is mounted on the distal end of the mounting bracket 104 which is connected to paddle 98 and is located nearest to the actuator rod's arm member 174. Placed over the mounting bracket's stud member 180 and the pin member 176 of the actuator rod's arm 174 is a spring 184. The spring 184 serves as a biasing means for pushing the actuator rod 158 in the direction of arrow 186.

Located on the first end of the actuator rod 158 is a plate 190. Positioned on the plate 190 is a sloped actuator block 192. As shown in FIG. 2 extending from paddle 96 and being adjacent to the sloped actuator block 192 is an angled projection 194. When paddle 96 is depressed towards the front of the circuit board 35, the angled projection 194 will press against the sloped actuator block 192 and thus cause the movement of the actuator rod 158 in the direction of arrow 196. In a preferred embodiment, the portion where the angled projection 194 presses against the sloped actuator block 192 is coated by SYN TECH's synthetic grease, part number NS-7092-C. (SYN TECH, Addison, Ill.).

On the second end 162 of the actuator rod 158 is a latching arm 198. The latching arm 198 is generally shaped like an "L" with its distal end pointing towards the first end 160 of the actuator rod 158 and abutting the rounded end portion 72 of the beam 70 having the notch 75. The abutment of the latching arm 198 against the beam 70 serves to limit the travel of the actuator rod 158 in the direction of arrow 196.

The operation of the invention will now be discussed starting with FIG. 2 which depicts both the off button 26 and the on button 28 being released. The cruise control system is asserted by depressing the on button 28 towards the front 14 of the main housing 12. As the on button 28 is depressed, its button driver 62' will press against the top portion 106 of paddle 98. Correspondingly, the contactor 140' will apply a back pressure force against nipple 130' as the contactor becomes deformed. In addition, the area where the button driver 62' abuts against the latching arm 198 of the actuator rod 158 will cause the actuator to slide in the direction of arrow 196.

As the on button 28 is depressed further towards the front 14 of the main housing 12, the distal end of the latching arm 198 will be driven into the notch 75 formed in the button driver 62'. The latching arm 198 is driven into the notch 75 due to the force being asserted on the actuator rod 158 by the spring 184 (See FIG. 4).

Figure 7:
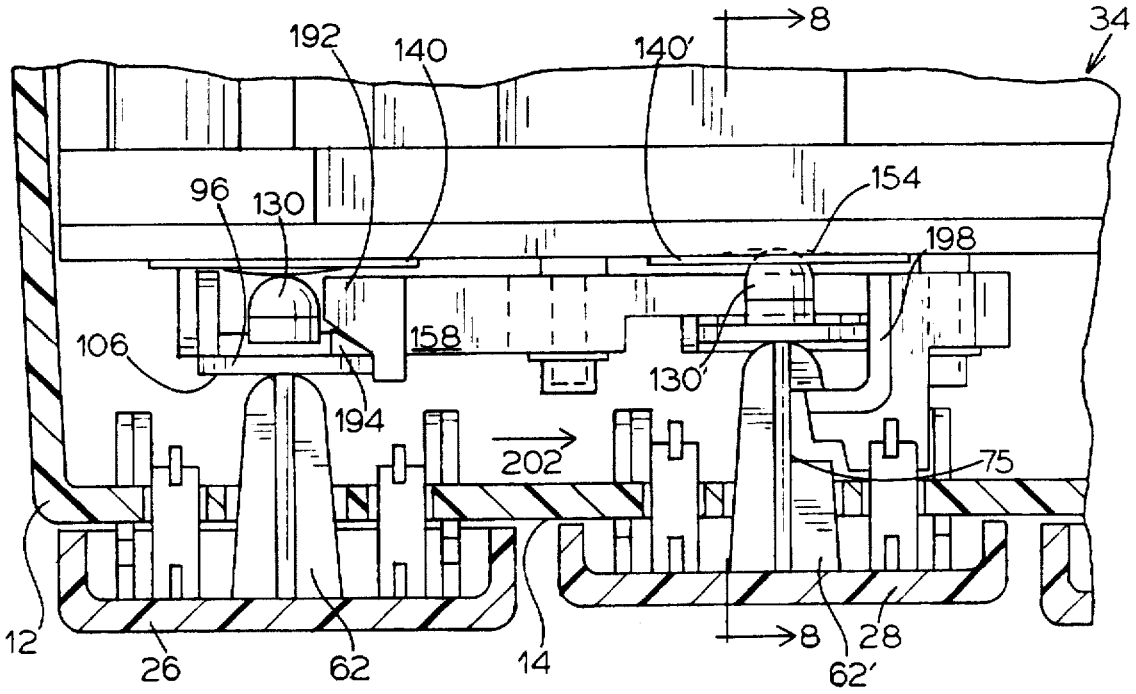
FIG. 7 is an enlarged cross-sectional plan view of the switching assembly shown in FIG. 2 with the on button being locked in the depressed position.

Turning to FIG. 7, an enlarged cross-sectional plan view of the switching assembly 34 shown in FIG. 2 is depicted with the on button 28 being locked in the depressed position. The on button 28 is locked in the depressed positioned by the distal end of the latching arm 198 which occupies the notch 75 in the button driver 62'. With the on button 28 being fully depressed and locked towards the front 14 of the main housing 12, the center section 154 of the contactor 140' will be deformed by pressure from nipple 130' of paddle 96.

Figure 8:
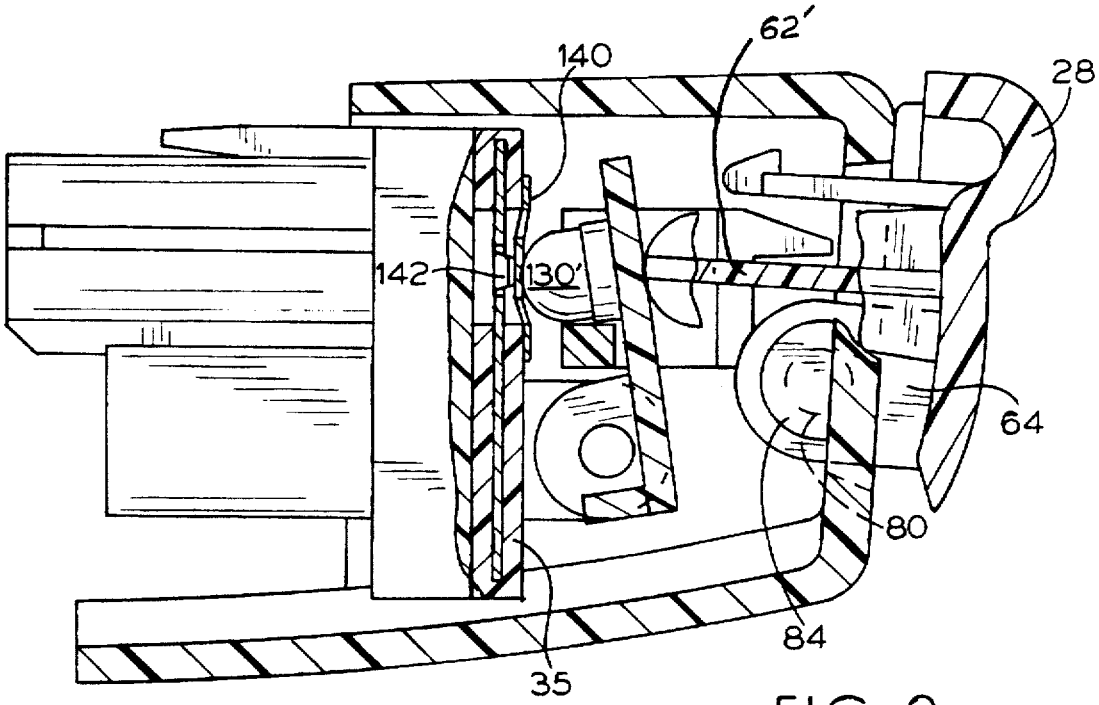
FIG. 8 is a cross-sectional side view of the switching assembly taken along line 8—8 of FIG. 7 with a partial fragmentary view of the on button's button driver.

Turning to FIG. 8, a cross-sectional side view of the switching assembly is depicted taken along line 8—8 of FIG. 7 with a partial fragmentary view of the on button's button driver 62'. As shown in FIG. 8, an electrical connection is constantly maintained between the deformed contactor 140' and the conductive finger 142 extending from the circuit board 35 when the on button 28 is locked in the depressed position via pressure applied by the button driver 62' as discussed above. Thus, the electrical connection formed between the contactor 140' and the conductive finger 142 corresponds to the on switch being toggled into the "on" or depressed position.

Figure 9:
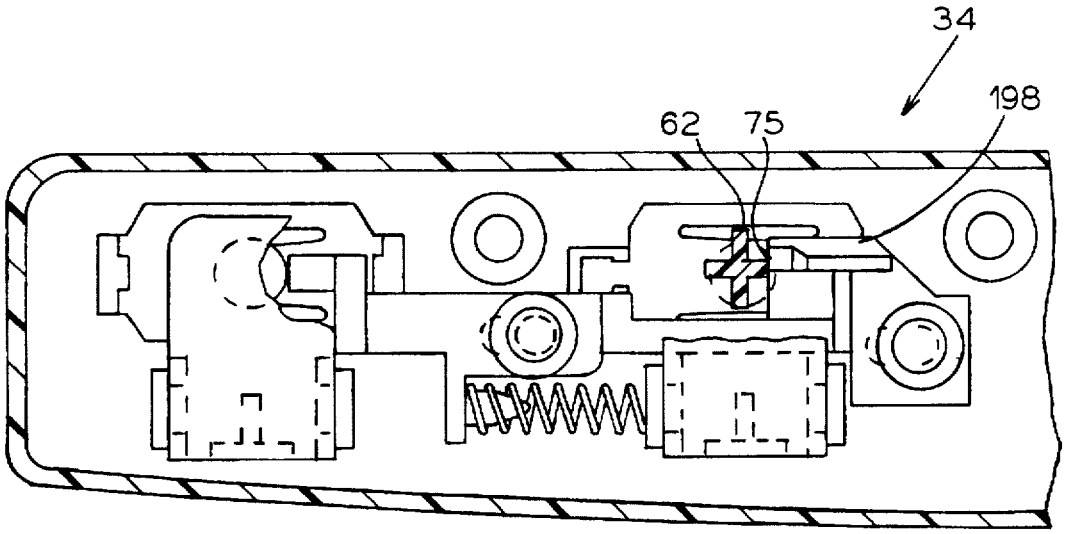
FIG. 9 is an enlarged front view of the main housing's switching assembly in FIG. 2 with a cut-away view of the button driver being locked in the depressed position.

In FIG. 9, an enlarged front view of the main housing's switching assembly 34 in FIG. 2 is depicted with a cut-away view of the button driver 62' being locked in the depressed position. The button driver 62' will only be released when the distal end of the latching arm 198 is vacated from the notch 75 in the button driver 62'. Correspondingly, turning back to FIG. 7, the on button 28 is released by depressing the off button 26 towards the front 14 of the main housing 12.

As the off button 26 is depressed, its button driver 62 will press against the top portion 106 of paddle 96. Correspondingly, the contactor 140 will apply a back pressure force as it becomes deformed by nipple 130. In addition, the angled projection 194 located on paddle 96 will sliding engage the sloped actuator block 192 on the actuator rod 158. The engagement between the angled projection 194 and the actuator block 192 will result in the actuator rod being slid in the direction of arrow 202.

Figure 10:
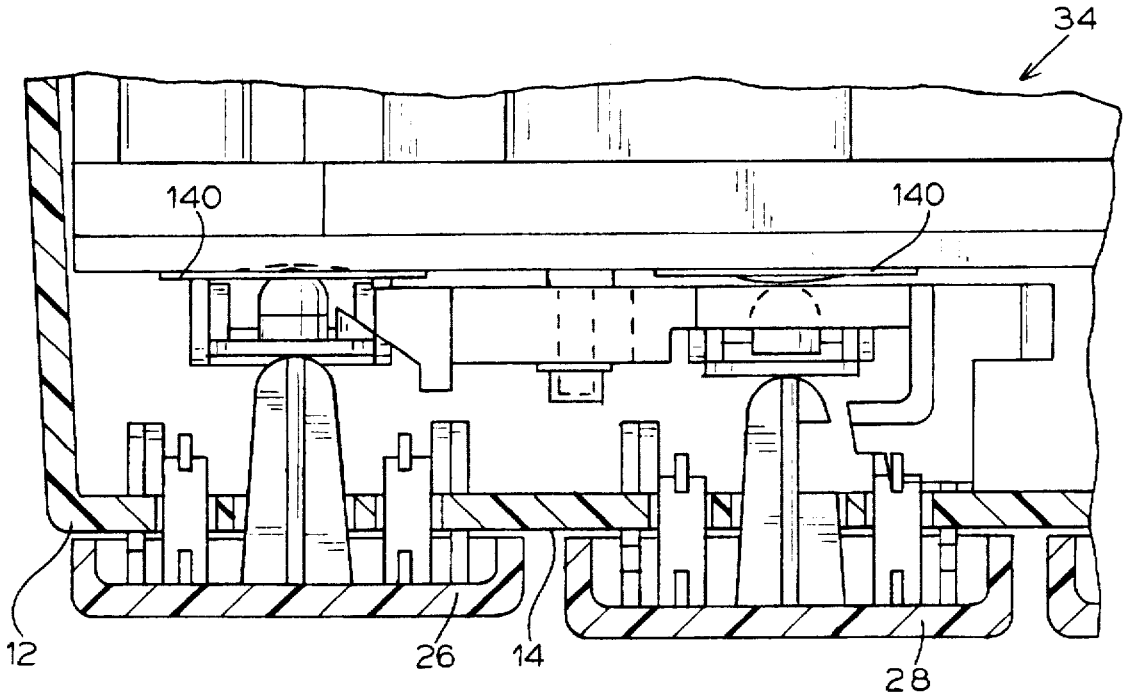
FIG. 10 is an enlarged cross-sectional plan view of the switching assembly shown in FIG. 2 with the off button being fully depressed.

As the actuator rod 158 slides in the direction of arrow 202, the distal end of the latching arm 198 will vacate the notch 75 located in the on button's button driver 62'. Turning to FIG. 10, an enlarged cross-sectional plan view of the switching assembly 34 in FIG. 2 is depicted with the off button 26 being fully depressed towards the front 14 of the main housing 12.

As shown in FIG. 7, the contactor 140' will be allowed to push the on button 28 into a released position when the off button 26 is fully depressed causing driver 62 to depress nipple 130 against contactor 140. In addition, the electrical connection between the contactor 140' and the conductive finger 142 will be toggled into the off position once the contactor has resiliently regained its initial shape due to the retraction of nipple 130' and correspondingly driver 62'. Finally, the off button 26 will be forced by the contactor 140 to regain its initial position shown in FIG. 2 once the pressure applied to the off button via a finger tip is removed.

In an alternative embodiment, the contactor 140' of the on button 28 may make or break an electrical connection via movement of ear 149 (See FIG. 3) of the contactor 140' instead of metal to metal contact of the center section 154 of the contactor 140' against finger member 142 (See FIG. 5) as discussed above.

It should be understood that in describing the top and bottom portions of the cruise control assembly 10, and its respective components, that the terms "top" and "bottom" are used by way of example only due to the orientation of the drawings. It should also be understood that various changes and modifications to the presently preferred embodiments described herein will be apparent to those skilled in the art. For example, instead of a cruise control assembly depicted in the presently preferred embodiment, the invention can be used in any other embodiment where an on switch with a separate off release actuator is desired. Likewise, a different scheme can be used to lock and release the on switch. Such changes and modifications may be made without departing from the spirit and scope of the present invention and without diminishing its attendant advantages. It is, therefore, intended that such changes and modifications be covered by the appended claims.

I claim:

1. A switching assembly comprising:

(a) an on button having a released position and a depressed position;

(b) a first button driver connected to said on button and responsive to said on button being in said released position or said depressed position;

(c) a first paddle abutting said first button driver and having a first nipple responsive to said on button being in said released position or said depressed position;

(d) a first contactor abutting said first nipple and having an on position and an off position with said position being determine by if said on button is in said depressed position or said released position respectively;

(e) an off button having a released position and a depressed position;

(f) a second button driver connected to said off button and responsive to said off button being in said released position or said depressed position;

(g) a second paddle abutting said second button driver and having a second nipple responsive to said off button being in said released position or said depressed position;

(h) a second contactor abutting said second nipple;

(i) an actuator rod abutting said first button driver and said second paddle for locking said first contactor in said on position when said on button is in said depressed position and releasing said contactor from said on position when said off button is in said depressed position; and (j) a spring connected to said actuator rod for maintaining said switch in said on position until said actuator rod is forced to release said contactor from said on position.

* * * * *